US005246749A

United States Patent [19]

Handzlik

[11] Patent Number: 5,246,749

[45] Date of Patent: Sep. 21, 1993

[54] SHOE MOUNTED NOVELTY DEVICE

[76] Inventor: Walter A. Handzlik, 1305 W. Chestnut St., West Bend, Wis. 53095

[21] Appl. No.: 826,923

[22] Filed: Jan. 24, 1992

[51] Int. Cl.[5] ..... A43B 23/24

[52] U.S. Cl. ..... 428/8; 2/245; 36/136; 428/4; 428/11; 428/24

[58] Field of Search ..... 428/11, 52, 4, 7, 8, 428/28, 24; 36/136; 2/245

[56] References Cited

U.S. PATENT DOCUMENTS 2,961,727 11/1960 Coffey ..... 428/11 X
4,801,478 1/1989 Greenblatt ..... 428/7 X
4,976,410 12/1990 Tomaiuolo ..... 428/31 X

*Primary Examiner*—Henry F. Epstein
*Attorney, Agent, or Firm*—Andrus, Sceales, Starke & Sawall

[57] ABSTRACT

A shoe mounted novelty device includes an elongate antenna like member having an inner end mounted on a shoe and an outer end projecting in an upright erect manner therefrom. An amusement or ornamental device such as a ball, flower, pompon or the like is secured to the outer end of the antenna member. The inner end of the antenna member is mounted to the shoe by a post which is clipped onto a component of the shoe.

8 Claims, 1 Drawing Sheet

SHOE MOUNTED NOVELTY DEVICE

BACKGROUND OF THE INVENTION

The present invention relates to novelty or fashion devices, and more particularly to a novelty or fashion device mounted on a user's shoe.

The most widely recognized amusement or novelty device utilized in connection with shoes are the pompon-like devices or tassels attached to boots of marching bands. These devices are ornamental balls or tufts of material attached by a cord or chain to dangle loosely from an ankle portion of the boot. Similar arrangements are sometime employed with ice skates and roller skates. Although such prior art devices are somewhat amusing, their use is primarily ornamental and employed to complement a costume or other clothing rather than being an attention-grabbing novelty or fashion device.

SUMMARY OF THE INVENTION

A shoe mounted device that is intended to be an attention grabbing novelty. The device includes an elongated antenna member having opposite ends, mounting means for removably mounting one end of the antenna member on a user's shoe, and securing means on the other end of the antenna member for securing an amusement or ornamental device thereon. More particularly, the antenna member comprises an elongated resilient plastic member that when attached to the user's shoe projects in an erect manner outwardly therefrom. The securing means on the outer end of the antenna member preferably comprises a series of openings formed therethrough to enable an amusement or ornamental device such as a ball, plastic flower, a pompom or the like to be secured thereon.

The mounting means enables a user to attach the device to a shoe by being clipped onto any number of shoe components such as the tongue of the shoe or through laces. The mounting means comprises a clip member having a base with an integral post projecting therefrom which is received within a blind bore formed in the inner end of the antenna member. The post includes a plurality of laterally extending pins integrally formed therein and spaced along its length for reception within corresponding openings communicating with the bore which are also formed at the inner end of the antenna member. Thus, the antenna member is firmly attached to the clip. However, the pins are designed to only partially project into their corresponding openings so as to provide sufficient frictional resistance to secure the antenna member on the clip yet allow the antenna member to be stripped from the clip should the antenna member become caught on something during use. Also, this enables the entire antenna member to be removed and replaced with another antenna member having a different amusement or ornamental device attached at its outer end without having to remove the amusement or ornamental device itself. The post is integrally attached to the base of a spring clip which is C-shaped to enable the clip to be slid over and attached to an edge of a shoe component.

BRIEF DESCRIPTION OF THE DRAWINGS

The drawings illustrate the best mode presently contemplated of carrying out the invention.

In the drawings.

DESCRIPTION OF THE PREFERRED EMBODIMENTS

Figure 1:
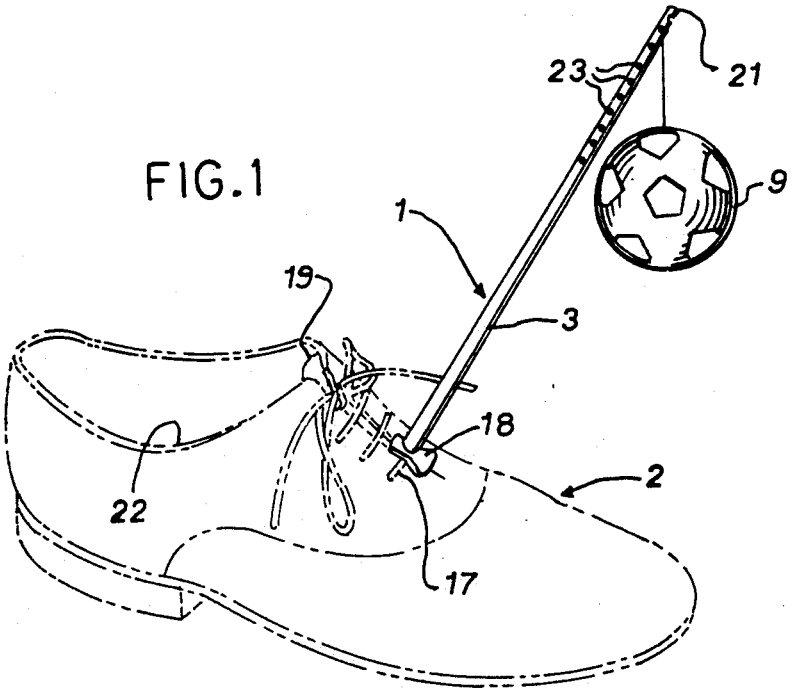
FIG. 1 is a perspective view of a shoe mounted novelty device constructed in accordance with the principles of the present invention.
Figure 2:
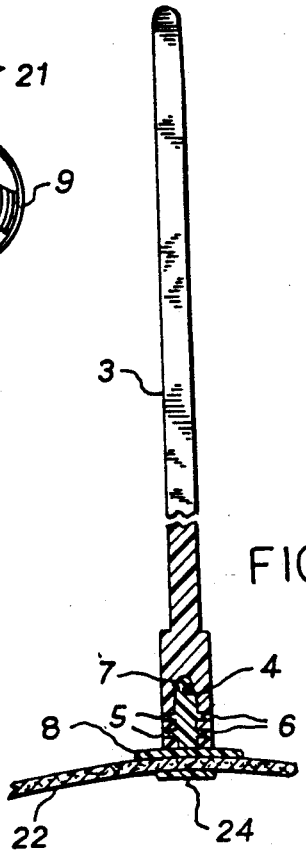
FIG. 2 is an end view in elevation with parts broken away and in cross section of the shoe mounted novelty device.

Referring now to the drawings, FIGS. 1 and 2 illustrate a novelty device generally designated by the numeral 1 which is mounted on a shoe generally designated by the numeral 2. It should be noted that although device 1 is illustrated as being utilized in connection with shoe 2 it is readily apparent that device 1 may be employed or utilized with other articles of clothing such as a shirt or blouse wherein it could be clipped onto one's sleeve or collar. As used herein the term "shoe" is employed in a generic sense, and encompasses any type of outer covering worn on the human foot such as boots, sandals, sneakers and the like.

As shown best in FIG. 2, device 1 includes an elongated antenna member 3 having an inner end and an outer free end. The inner end of antenna member 3 is generally thicker than its outer end. Antenna member 3 is composed of a plastic material having sufficient rigidity to enable member 3 to project from shoe 2 in an erect manner when attached thereto. Thus, antenna member 3 is relatively rigid, but yet has some inherent resiliency to enable an amusement or ornamental device to "bounce" at its outer end when a user is walking or running.

Figure 6:
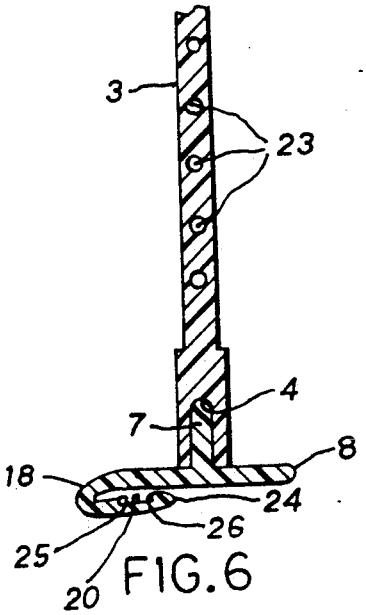
FIG. 6 is a fragmentary cross sectional side view in elevation of the shoe mounted novelty device.

As shown best in FIGS. 2 and 6, antenna member 3 is a solid rectangular-shaped member having a plurality of spaced cylindrical openings 23 formed therethrough. Its inner end includes a blind post-receiving bore 4 formed therein, and its outer end includes a hook 21 formed at its free end. Bore 4 is formed along the longitudinal axis of antenna member 3. The inner end of antenna member 3 also includes a plurality of spaced openings 5 formed therein extending between bore 4 and the sides of antenna member 3. Openings 5 cooperate with a corresponding plurality of pins 6 formed along and projecting laterally from the length of a post 7 which in turn is integrally formed and projects from a thin disk shaped base member 8. Post 7 is substantially rectangular in shape and is composed of a plastic material similar to that for antenna member 3. The pins 6 on post 7 cooperate with openings 5 by projecting only partially into openings 5 to provide a means for removably attaching antenna member 3 to post 7 by providing an interference fit therewith. The pins 6 provide sufficient frictional resistance to secure antenna member 3 onto post 7 yet allow antenna member 3 to be "stripped" from post 7 if desired. The pins 6 and openings 5 are preferably designed so that it requires about eight pounds of force to push antenna member 3 onto post 7 or to pull antenna member 3 off post 7. Thus, antenna member 3 may be removably mounted from post 7 since pins 6 provide frictional resistance allowing antenna member 3 to be stripped from post 7 should antenna member 3 become caught or entangled with something during use. Also, this enables the entire antenna member 3 with device 9 still thereon to be removed and replaced with another antenna member having a different amusement or ornamental device attached at its outer end without having to remove the amusement or ornamental device itself.

Figure 3:
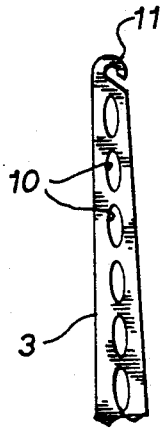
FIG. 3 is a fragmentary view of the outer end of the antenna member illustrating a second embodiment of a means for securing an ornamental device to the antenna member.
Figure 4:
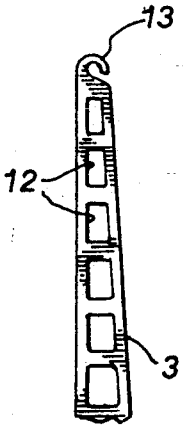
FIG. 4 is a view similar to FIG. 3 except illustrating a third embodiment of the securing means.
Figure 5:
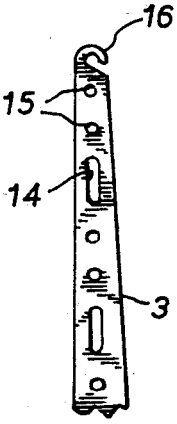
FIG. 5 is a view similar to FIGS. 3 and 4 illustrating yet a fourth embodiment of the securing means for the outer end of the antenna member.

FIGS. 3-5 show three alternate means for securing an amusement or ornamental device such as a ball 9, flower, pompon or the like to the outer end of antenna member 3. FIG. 3 illustrates a plurality of serially orientated oblong openings 10 formed through the outer end of member 3. In addition, a hook 11 is formed at the extreme free end of member 3. FIG. 4 shows a second alternate embodiment for the securing means as being a plurality of serially orientated rectangular shaped openings 12 together with a hook 13 once again formed on the extreme free end of member 3. Finally, FIG. 5 illustrates yet a third embodiment of the securing means wherein a plurality of different sized openings are formed serially in the outer end of member 3. As illustrated, large oblong openings 14 sequentially follow a pair of smaller openings 15. Once again, a hook 16 is formed on the extreme free end of member 3. Also, as shown in FIGS. 3-5 member 3 is tapered in that its outer end is narrower than its inner end as opposed to being rectangular shaped throughout its length as shown in the embodiment of FIGS. 1 and 6. Thus, any number of amusement and/or ornamental devices may be secured utilizing one or more of the illustrated openings either alone or in combination with hooks 11, 13 and 16. Such devices would typically be tied to the outer end of member 3 utilizing either string or some other conventional method.

As illustrated in FIG. 1, the novelty device is shown mounted to a through lace 17 of shoe 2. As illustrated in FIG. 2, the novelty device is shown mounted to collar 22 of shoe 2. Thus, the device may be clipped onto any number of shoe components, or as previously mentioned, to other articles of clothing.

Referring now to FIG. 6, post 7 is integrally attached to base 8 which forms a component of a C-shaped base or clip member 18. Clip member 18 is formed of a resilient plastic material so as to enable it to be spring loaded whereby it may be attached over the edge of a shoe component e.g. over the edge of tongue 19 of shoe 2, collar 22 of shoe 2 or laces 17 of shoe 2, and remain mounted thereon. As an aid to retaining base 18 on shoe 2, base 18 includes a groove 20 formed in the lower lip 24 of member 18. Groove 20 provides shoulders 25 and 26 to help "catch" on and hold onto the shoe component to which it is attached. Member 18 thus provides a "clip on" function for quickly mounting and removing device 1 from various components of shoe 2.

Various modes of carrying out the invention are contemplated as being within the scope of the following claims particularly pointing out and distinctly claiming the subject matter regarded as the invention.

I claim:

1. A novelty device, comprising:

an elongate antenna member having an inner end and outer end, said antenna member composed of a semi-rigid resilient material;

means for mounting the inner end of the antenna member to a shoe so that said antenna member projects outwardly and in an erect manner from said shoe, said mounting means comprising a base member, first means for removably attaching said antenna member to said base member, and second means for removably attaching said base member to said shoe; and means on said antenna member for securing an amusement device to the outer end of the antenna member.

2. The novelty device of claim 1 wherein said securing means comprises at least one opening formed through the outer end of the antenna member.

3. The novelty device of claim 2 wherein said securing means further includes a hook member formed on the outer end of said antenna member.

4. The novelty device of claim 1 wherein said base member includes an integral upright post projecting therefrom and said antenna member includes a post receiving bore formed in the inner end of said antenna member.

5. The novelty device of claim 4 wherein said first attaching means cooperates between said post and the inner end of said antenna member to permit attachment of said antenna member onto said post and removal of said antenna member from said post upon the application of sufficient force to said antenna member.

6. The novelty device of claim 5 wherein said first attaching means comprises at least one pin projecting laterally from said post and a pin-receiving opening formed in the inner end of said antenna member and communicating with said bore.

7. The novelty device of claim 6 wherein there are a plurality of spaced pins formed along the longitudinal length of said post and a corresponding number of pin-receiving openings formed in said antenna member.

8. The novelty device of claim 5 wherein said base member comprises a C-shaped member having a flat first portion from which said upright post projects, and a resilient integral lip portion, said lip potion comprising said second attaching means.

* * * * *